US012653235B2

(12) United States Patent
Wu et al.

(10) Patent No.: US 12,653,235 B2
(45) Date of Patent: Jun. 16, 2026

(54) HEATER AND CIGARETTE UTENSIL CONTAINING SAME

(71) Applicant: SHENZHEN FIRST UNION TECHNOLOGY CO., LTD., Shenzhen Guangdong Province (CN)

(72) Inventors: Jian Wu, Shenzhen Guangdong Province (CN); Zuqiang Qi, Shenzhen Guangdong Province (CN); Zhongli Xu, Shenzhen Guangdong Province (CN); Yonghai Li, Shenzhen Guangdong Province (CN)

(73) Assignee: SHENZHEN FIRST UNION TECHNOLOGY CO., LTD., Shenzhen Guandong Province (CN)

( * ) Notice: Subject to any disclaimer, the term of this patent is extended or adjusted under 35 U.S.C. 154(b) by 790 days.

(21) Appl. No.: 17/757,777

(22) PCT Filed: Dec. 23, 2020

(86) PCT No.: PCT/CN2020/138675
§ 371 (c)(1),
(2) Date: Jun. 21, 2022

(87) PCT Pub. No.: WO2021/129675
PCT Pub. Date: Jul. 1, 2021

(65) Prior Publication Data

US 2023/0337737 A1 Oct. 26, 2023

(30) Foreign Application Priority Data

Dec. 23, 2019 (CN) ..... 201911336288.9

(51) Int. Cl.
*A24F 40/46* (2020.01)
*A24F 40/20* (2020.01)
(Continued)

(52) U.S. Cl.
CPC ..... *A24F 40/46* (2020.01); *A24F 40/20* (2020.01); *A24F 40/57* (2020.01); *A24F 40/70* (2020.01); *A24F 40/51* (2020.01); *A24F 40/53* (2020.01)

(58) Field of Classification Search
None
See application file for complete search history.

(56) References Cited

U.S. PATENT DOCUMENTS

2016/0021930 A1 1/2016 Minskoff et al.
2018/0153213 A1 6/2018 Heamon

FOREIGN PATENT DOCUMENTS

CN 101523975 A 9/2009
CN 102036433 A 4/2011
(Continued)

*Primary Examiner* — Linda L Gray
(74) *Attorney, Agent, or Firm* — Proi Intellectual Property US

(57) ABSTRACT

The present disclosure relates to the field of smoking sets and provides a heater and a cigarette utensil containing same. The heater comprises a base having a surface; and a first electrode film, an infrared film, and a second electrode film are sequentially formed on the surface of the base along the direction perpendicular to the surface of the base, wherein the first electrode film and the second electrode film are electrically connected to a power supply. The infrared film is used for generating the heat under the function of the electric power, and transferring the generated heat to an aerosol forming matrix at least in an infrared radiation manner to generate the aerosol for inhaling. The conductive cross-sectional area of the infrared film is increased, the electric heating conversion rate of the infrared film is increased, the pre-heating time of the aerosol forming matrix is shortened, and the user experience is improved.

19 Claims, 10 Drawing Sheets

(51) Int. Cl.

| | |
|---|---|
| ***A24F 40/51*** | (2020.01) |
| ***A24F 40/53*** | (2020.01) |
| ***A24F 40/57*** | (2020.01) |
| ***A24F 40/70*** | (2020.01) |

(56) References Cited

FOREIGN PATENT DOCUMENTS

| | | | |
|---|---|---|---|
| CN | 106060980 | A | 10/2016 |
| CN | 108338415 | A | 7/2018 |
| CN | 108338417 | A | 7/2018 |
| CN | 108369041 | A | 8/2018 |
| CN | 108431525 | A | 8/2018 |
| CN | 109674093 | A | 4/2019 |
| CN | 109832674 | A | 6/2019 |
| CN | 109846093 | A | 6/2019 |
| CN | 208925253 | U | 6/2019 |
| CN | 110384264 | A | 10/2019 |
| CN | 110464052 | A | 11/2019 |
| JP | 2004269295 | A | 9/2004 |

HEATER AND CIGARETTE UTENSIL CONTAINING SAME

CROSS REFERENCE TO RELATED APPLICATION(S)

This application claims priority to Chinese Patent Application No. 201911336288.9, entitled "Heater and cigarette utensil containing same" and submitted to China National Intellectual Property Administration on Nov. 23, 2019, the entire content of which is incorporated herein by reference.

TECHNICAL FIELD

The embodiment of the present disclosure relates to the technical field of smoking sets, and in particular to a heater and a cigarette utensil containing same.

BACKGROUND

Tobacco products (e.g., cigarettes, cigars, etc.) are burning tobaccos to produce tobacco smoke during use. People attempt to make products that release compounds without burning so as to replace these tobacco products burning tobaccos. An example of this kind of products is a heating device, which heats rather than burns a material to release compounds.

According to an existing low temperature heating non-burning smoking set, an infrared coating and a conductive coating are mainly applied on an outer surface of a base, and the infrared coating, after electrified, emits infrared rays which penetrate through the base to heat an aerosol forming matrix inside the base; since the infrared rays have a strong penetrability, they can penetrate through the periphery of the aerosol forming matrix to enter the inside, to achieve uniform heating of the aerosol forming matrix.

The main problems with the above structure are as follows. The conductive cross-sectional area of the infrared coating is relatively small and the electrothermal conversion rate of the infrared film is relatively low, resulting in that the pre-heating time of the aerosol forming matrix is relatively long and the user experience is reduced.

SUMMARY

The embodiment of the present disclosure aims to provide a heater and a cigarette utensil containing same, which increase the electrothermal conversion rate of an infrared film by increasing the conductive cross-sectional area of the infrared film, shortens the pre-heating time of an aerosol forming matrix and solves the problem with the existing cigarette utensil that the conductive cross-sectional area of the infrared film is small.

In order to solve the above technical problem, an embodiment of the present disclosure employs one technical scheme as follows. A heater is provided, which is configured to heat an aerosol forming matrix and vaporize at least one ingredient of the aerosol forming matrix to form an aerosol for a user to inhale; the heater includes: a base provided with an inner surface and an outer surface; and a first electrode film, an infrared film, and a second electrode film sequentially formed on the outer surface or inner surface of the base along a direction perpendicular to the surface of the base; wherein both of the first electrode film and the second electrode film are provided with an electrical connection portion, the electrical connection portion of the first electrode film and the electrical connection portion of the second electrode film are electrically connected to positive and negative electrodes of a power supply respectively, so that an electric power of the power supply is fed to the infrared film; and the infrared film is configured to receive the electric power and generate heat under the function of the electric power, the generated heat being used for heating the aerosol forming matrix at least in an infrared radiation manner.

Optionally, the first electrode film covers at least part of the outer surface of the base, the infrared film and the second electrode film cover part of an outer surface of the first electrode film; the electrical connection portion of the first electrode film is formed on an outer surface portion of the first electrode film that is not covered by the infrared film and the second electrode film, and the electrical connection portion of the second electrode film is formed at any position on an outer surface of the second electrode film.

Optionally, the first electrode film has a greater length along a longitudinal direction of the base than the infrared film, and the second electrode film has an equal or smaller length along the longitudinal direction of the base than the infrared film.

Optionally, the first electrode film covers at least part of the outer surface of the base and extends to the inner surface of the base along the outer surface of the base, the infrared film and the second electrode film cover part of the outer surface of the first electrode film; the electrical connection portion of the first electrode film is formed on the portion of the first electrode film that extends to the inner surface of the base, and the electrical connection portion of the second electrode film is formed at any position on the outer surface of the second electrode film.

Optionally, the first electrode film, the infrared film and the second electrode film are all continuous films.

Optionally, the first electrode film is a non-continuous film.

Optionally, the first electrode film is a patterned conductive track.

Optionally, the first electrode film includes a current collecting portion and a finger electrode portion, at least part of the current collecting portion forms the electrical connection portion of the first electrode film, and electrode fingers of the finger electrode portion substantially extend along the surface of the base longitudinally.

Optionally, the first electrode film includes a current collecting portion and a mesh electrode portion, and at least part of the current collecting portion forms the electrical connection portion of the first electrode film.

Optionally, a shape of a mesh hole of the mesh electrode portion includes at least one of square, circle, diamond, triangle or irregular shapes.

Optionally, the first electrode film includes a first spiral electrode electrically connected to an inner surface of the infrared film, and the first spiral electrode extends spirally along the longitudinal direction of the base.

Optionally, the first spiral electrode extends along the longitudinal direction of the base with a constant pitch.

Optionally, the first spiral electrode extends along the longitudinal direction of the base with a variable pitch.

Optionally, the first electrode film and/or the second electrode film include(s) at least two portions that are electrically disconnected to each other, to divide the surface of the base into at least a first area and a second area; the first area and the second area can be controlled individually, to achieve controllable heating of different areas.

Optionally, the first electrode film and/or the second electrode film are(is) separated into a first partial electrode film and a second partial electrode film along the longitudinal direction of the base, and segmented heating of the aerosol forming matrix is performed by individually controlling the electric power fed to the first partial electrode film and/or the second partial electrode film.

Optionally, the first electrode film includes at least one of silver, gold, platinum or copper.

Optionally, the first electrode film has a thickness less than 800 nanometers, preferably less than 700 nanometers, more preferably less than 500 nanometers, further more preferably less than 300 nanometers, and still further more preferably less than 100 nanometers.

Optionally, the second electrode film includes at least one of gold, silver, aluminum, platinum, titanium, or indium tin oxide.

Optionally, the first electrode film and the second electrode film are prepared by a physical vapor deposition method.

Optionally, the base includes at least one of quartz glass, sapphire, silicon carbide, magnesium fluoride ceramic, yttrium oxide ceramic, magnesium aluminum spinel ceramic, yttrium aluminum garnet single crystal or germanium single crystal.

Optionally, the infrared film includes at least one of oxide, carbon material, carbide or nitride.

An embodiment of the present disclosure employs one technical scheme as follows. A cigarette utensil is provided, including a shell assembly and the above heater; the heater is arranged within the shell assembly.

Optionally, the cigarette utensil further includes a hollow heat insulation tube; the heat insulation tube is arranged at the periphery of the heater, to prevent, at least partially, conduction of heat from the heater towards the shell assembly.

The embodiment of the present disclosure has the following beneficial effects.

According to the heater and the cigarette utensil containing same provided in the present disclosure, by sequentially forming a first electrode film, an infrared film, and a second electrode film on the surface of the base along the direction perpendicular to the surface of the base, the conductive cross-sectional area of the infrared film is increased, the electric heating conversion rate of the infrared film is increased, the pre-heating time of the aerosol forming matrix is shortened, and the user experience is improved.

BRIEF DESCRIPTION OF THE DRAWINGS

One or more embodiments are illustrated through the image(s) in corresponding drawing(s). These illustrations do not form restrictions to the embodiments. Elements in the drawings with a same reference number are expressed as similar elements, and the images in the drawings do not form proportional restrictions unless otherwise stated.

DETAILED DESCRIPTION

To make the purpose, the technical scheme and the advantages of the embodiments of the present disclosure more apparent and understandable, a clear and complete description is provided below to the technical scheme in the embodiments of the present disclosure in conjunction with the drawings in the embodiments of the present disclosure. Obviously, the embodiments described hereinafter are simply part embodiments of the present disclosure, but all the embodiments. It should be understood that the exemplary embodiments described below are merely to illustrate, but to limit, the present disclosure. All other embodiments obtained by the ordinary staff in the field based on the embodiments in the present disclosure without creative work are intended to be included in the scope of protection of the present disclosure.

It is to be noted that when an element is described as "fixed to" another element, it may be directly on the another element, or there might be one or more intermediate elements between them. When one element is described as "connected to" another element, it may be directly connected to the another element, or there might be one or more intermediate elements between them. Terms "vertical", "horizontal", "left", "right," and similar expressions used in this description are merely for illustration.

In addition, technical features involved in each embodiment of the present disclosure described below can be combined mutually if no conflict is incurred.

Embodiment 1

Figure 1:
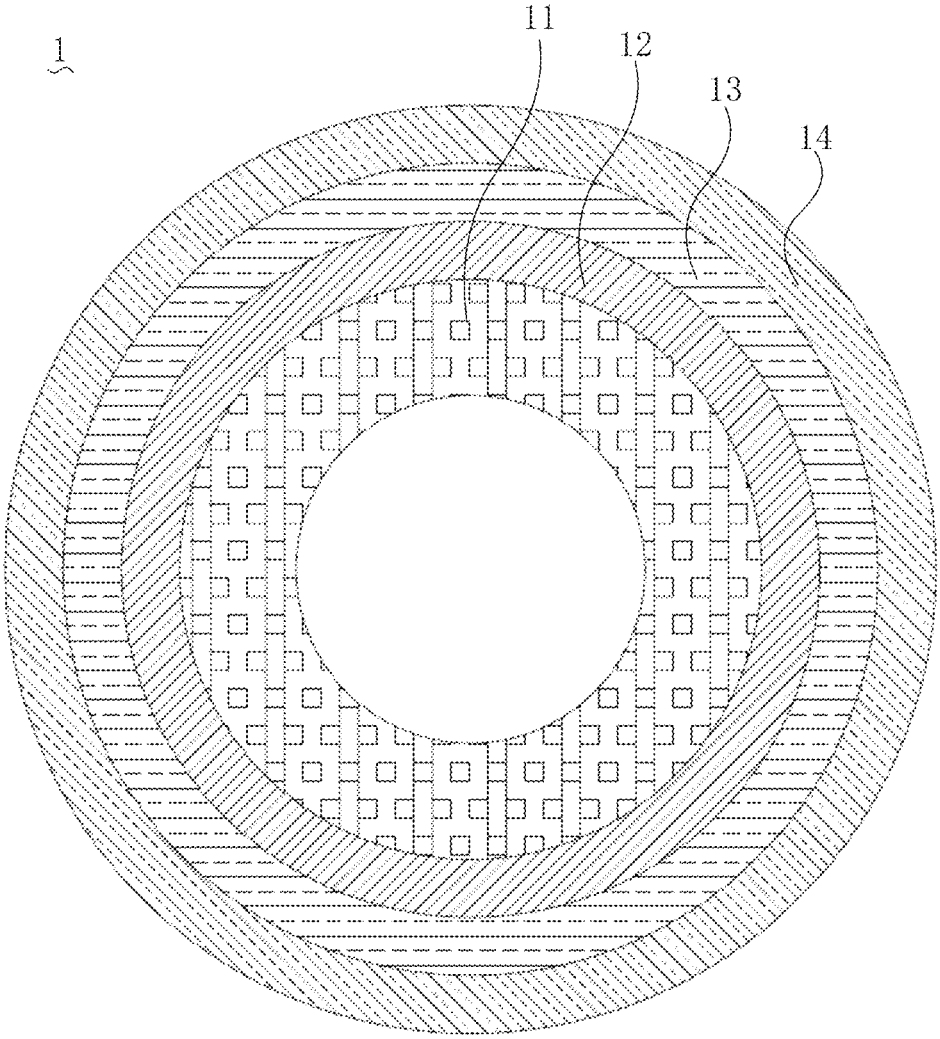
FIG. 1 is a diagram of a heater according to Embodiment 1 of the present disclosure.

As shown in FIG. 1, an Embodiment 1 of the present disclosure provides a heater, configured to heat an aerosol forming matrix and vaporize at least one ingredient of the aerosol forming matrix to form an aerosol for a user to inhale; the heater 1 includes a base 11, a first electrode film 12, an infrared film 13, and a second electrode film 14.

The base 11 forms a space configured to accommodate the aerosol forming matrix, and an inner surface of the base 11 forms at least partial boundary of the space.

Figure 2:
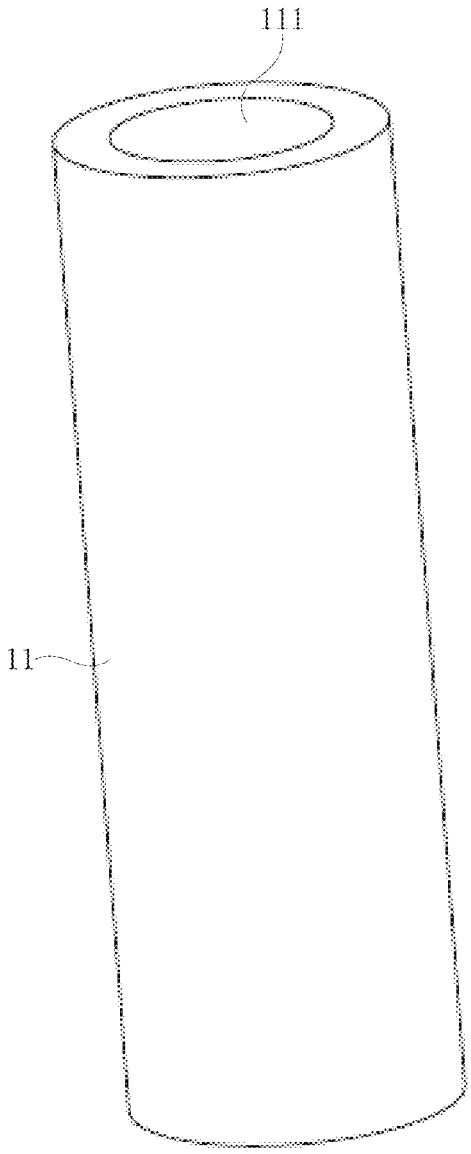
FIG. 2 is a diagram of a base according to Embodiment 1 of the present disclosure.

Referring to FIG. 2, the base 11 is provided with opposite first end and second end, and the base 11 extends between the first end and the second end along the longitudinal direction and is hollow inside to form a chamber 111 suitable for housing the aerosol forming matrix. The base 11 may be shaped as hollow cylinder, prism or other pillars. The base 11 preferably is shaped as cylinder. The chamber 111 is a cylindrical hole running through the middle of the base 11, and the internal diameter of the hole is slightly greater than the external diameter of the aerosol forming product or smoking product, so that the aerosol forming product or smoking product may be arranged within the chamber 111 to be heated.

The base 11 may be made of materials that are resistant to high temperature and have a high infrared transmittance, including but not limited to the following materials: quartz glass, sapphire, silicon carbide, magnesium fluoride ceramic, yttrium oxide ceramic, magnesium aluminum spinel ceramic, yttrium aluminum garnet single crystal, germanium single crystal and so on. Preferably, the base 11 is made of quartz glass.

The aerosol forming matrix is a matrix capable of releasing volatile compounds that can form an aerosol. This kind of volatile compounds can be released by heating the aerosol forming matrix. The aerosol forming matrix may be solid or liquid or contain solid or liquid components. The aerosol forming matrix may be loaded onto a carrier or a support element by way of adsorbing, coating, dipping or other methods. Simply, the aerosol forming matrix may be part of the aerosol generation product or smoking product.

The aerosol forming matrix may include nicotine. The aerosol forming matrix may include tobacco, for example, may include a tobacco contained material containing volatile tobacco flavor compounds that are released from the aerosol forming matrix when heated. Preferably, the aerosol forming matrix may include homogeneous tobacco materials, for example, deciduous tobaccos. The aerosol forming matrix may include at least one aerosol forming agent, which may be any appropriate known compound or mixture of compounds. During usage, the compound or mixture of compounds is conducive to densification and stable formation of aerosol and is basically resistant to thermal degradation at the operating temperature of the aerosol generation system. Appropriate aerosol forming agents are well known in relevant fields, including but not limited to: polyols, e.g., triethylene glycol, 1,3-butanediol and glycerol; esters of polyols, e.g., glycerol monoacetate, diacetate or triacetate; and fatty acid esters of monocarboxylic, dicarboxylic or polycarboxylic acids, e.g., dimethyldodecane diacid ester and dimethyl tetradecane diacetate. A preferable aerosol forming agent is polyhydroxy alcohols or a mixture thereof, for example, triethylene glycol, 1,3-butanediol, and the most preferable is glycerol.

Figure 3:
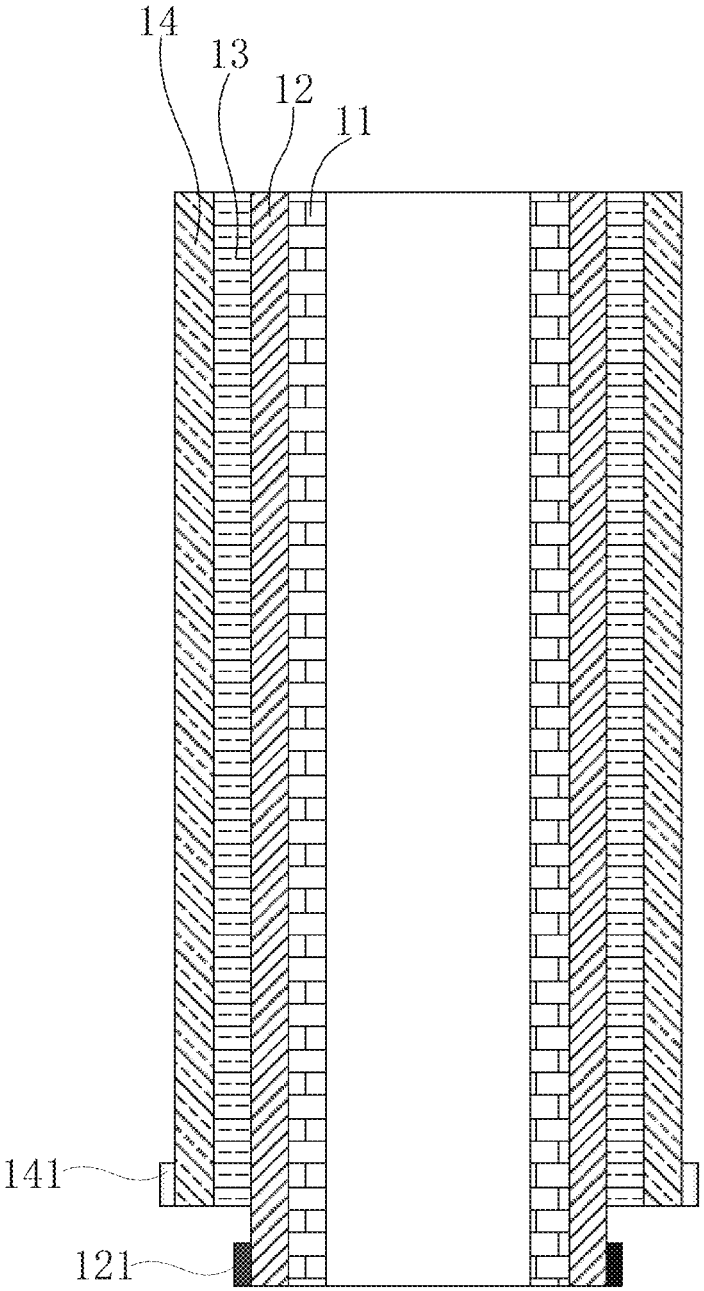
FIG. 3 is a sectional view of FIG. 1.

Referring to FIG. 3, the first electrode film 12, the infrared film 13 and the second electrode film 14 are sequentially formed on the surface of the base 11 along a radial direction of the cylindrical base 11. They may be formed on an outer surface of the base 11, also may be formed on an inner surface of the base 11. Preferably, the first electrode film 12, the infrared film 13 and the second electrode film 14 are sequentially formed on the outer surface of the base 11 along the radial direction of the cylindrical base 11.

The first electrode film 12 is provided with an electrical connection portion 121, the second electrode film 14 is provided with an electrical connection portion 141, the electrical connection portion 121 and the electrical connection portion 141 are electrically connected to positive and negative electrodes of a power supply respectively, for example, the first electrode film 12 is electrically connected to the positive electrode, and the second electrode film 14 is electrically connected to the negative electrode; alternatively, the first electrode film 12 is electrically connected to the negative electrode, and the second electrode film 14 is electrically connected to the positive electrode.

Through the electrical connection portion 121 and the electrical connection portion 141, the first electrode film 12 and the second electrode film 14 feed the electric power of the power supply to the infrared film 13. Under the function of the electric power, the infrared film 13 may generate heat and may generate infrared rays of certain wavelength, for example, infrared rays of 2 μm~24 μm.

The first electrode film 12 may employ materials with good conductivity and low impact on infrared transmittance, including but not limited to silver, gold, platinum or copper. The first electrode film 12 has a thickness less than 800 nanometers, preferably less than 700 nanometers, more preferably less than 500 nanometers, further more preferably less than 300 nanometers, and still further more preferably less than 100 nanometers. The selection of materials with low thickness and high conductivity may reduce the blocking reflection of the infrared rays by the first electrode film while ensuring the electric conductivity.

The second electrode film 14 may employ materials with good conductivity and high infrared reflectivity, including but not limited to gold, silver, aluminum, platinum, titanium, or indium tin oxide.

Both of the first electrode film 12 and the second electrode film 14 may be formed on the outer surface of the base 11 by a physical vapor deposition method, a chemical vapor deposition method or a spraying method. Preferably, they are formed on the outer surface of the base 11 by a physical vapor deposition method.

Referring to FIG. 3, in this example, the first electrode film 12 covers the entire outer surface of the base 11, the infrared film 13 and the second electrode film 14 cover part of an outer surface of the first electrode film 12; the electrical connection portion 121 of the first electrode film 12 is formed on an outer surface portion of the first electrode film 12 that is not covered by the infrared film 13 and the second electrode film 14, and the electrical connection portion 141 of the second electrode film 14 is formed at any position on an outer surface of the second electrode film 14. The first electrode film 12 has a greater length along a longitudinal direction of the base 11 than the red infrared film 13, and the second electrode film 14 has an equal length along the longitudinal direction of the base 11 as the red infrared film 13.

In other examples, it is also possible that the first electrode film 12 covers part of the outer surface of the base 11 and the second electrode film 14 has a smaller length along the longitudinal direction of the base 11 than the red infrared film 13.

In an example, the first electrode film 12 covers at least part of the outer surface of the base 11 and extends to the inner surface of the base 11 along the outer surface of the base 11, that is, the first electrode film 12 includes an outer surface portion covering the base 11 (which may cover partial or entirety of the outer surface of the base), a radial portion covering the base 11, and an inner surface portion covering the base 11 (which covers partial of the inner surface). The infrared film 13 and the second electrode film 14 cover part of the outer surface of the first electrode film 12.

The electrical connection portion 121 of the first electrode film 12 is formed on the inner surface portion covering the base 11, the electrical connection portion 141 of the second electrode film 14 is formed at any position on the outer surface of the second electrode film 14.

In this example, both of the first electrode film 12 and the second electrode film 14 are plane electrodes, that is, both of the first electrode film 12 and the second electrode film 14 are continuous films. Specifically, the first electrode film 12 clads an inner surface of the infrared film 13, and the second electrode film 14 clads an outer surface of the infrared film 13. The plane electrode increases the conductive cross-sectional area of the infrared film 13, increases the electrothermal conversion rate of the infrared film 13, shortens the pre-heating time of the aerosol forming matrix and improves the user experience.

Figure 4:
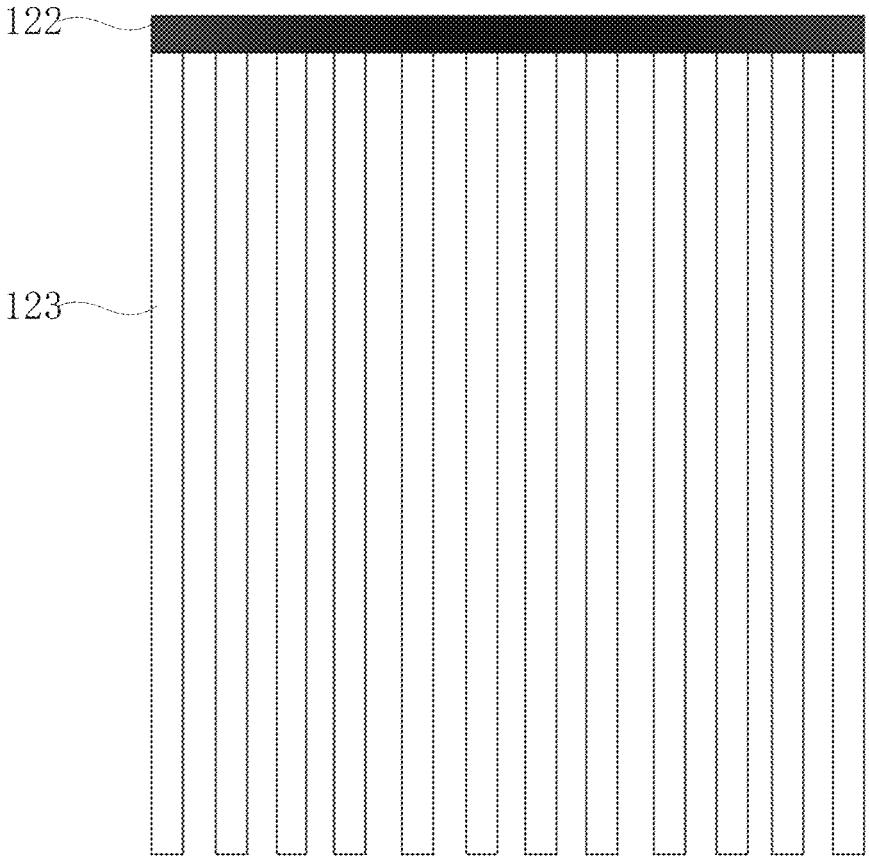
FIG. 4 is a diagram of expansion of a current collecting portion and a finger electrode portion according to Embodiment 1 of the present disclosure.

In an example, the first electrode film 12 may be a non-continuous film. Referring to FIG. 4, the first electrode film 12 includes a current collecting portion 122 and a finger electrode portion 123, at least part of the current collecting portion 122 forms the electrical connection portion 121 of the first electrode film 12, and electrode fingers of the finger electrode portion 123 substantially extend along the surface of the base 11 longitudinally.

Figure 5:
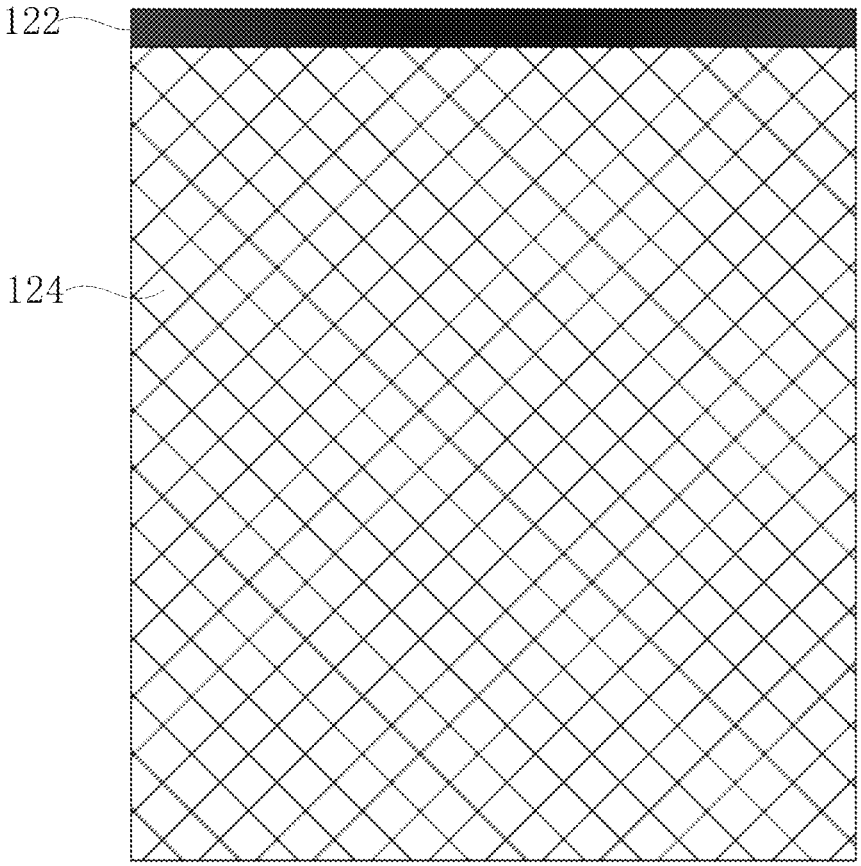
FIG. 5 is a diagram of expansion of a current collecting portion and a mesh electrode portion according to Embodiment 1 of the present disclosure.

Referring to FIG. 5, in an example, the first electrode film 12 includes a current collecting portion 122 and a mesh electrode portion 124, at least part of the current collecting portion 122 forms the electrical connection portion 121 of the first electrode film 12, and a mesh hole of the mesh electrode portion 124 is shaped as diamond. It is to be noted that the mesh hole of the mesh electrode portion 124 may also be shaped as square, circle, triangle or irregular shapes, etc.

Figure 6:
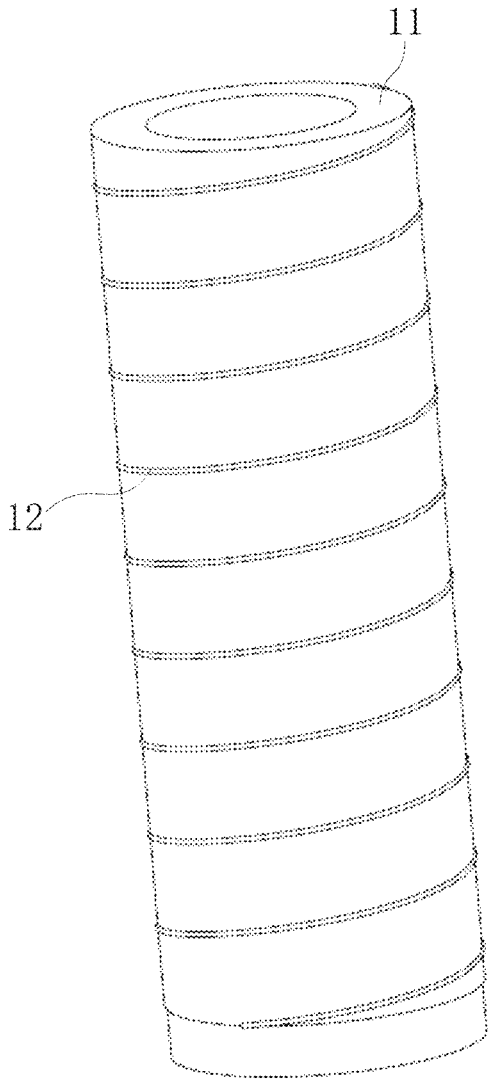
FIG. 6 is a diagram of a heater provided with a spiral electrode according to Embodiment 1 of the present disclosure.

Referring to FIG. 6, in an example, the first electrode film 12 is a spiral electrode, and the spiral electrode extends along the longitudinal direction of the base 11 with a constant pitch. The spiral electrode in this example may also increase the conductive cross-sectional area of the infrared film 13 and increase the electrothermal conversion rate of the infrared film 13.

Figure 7:
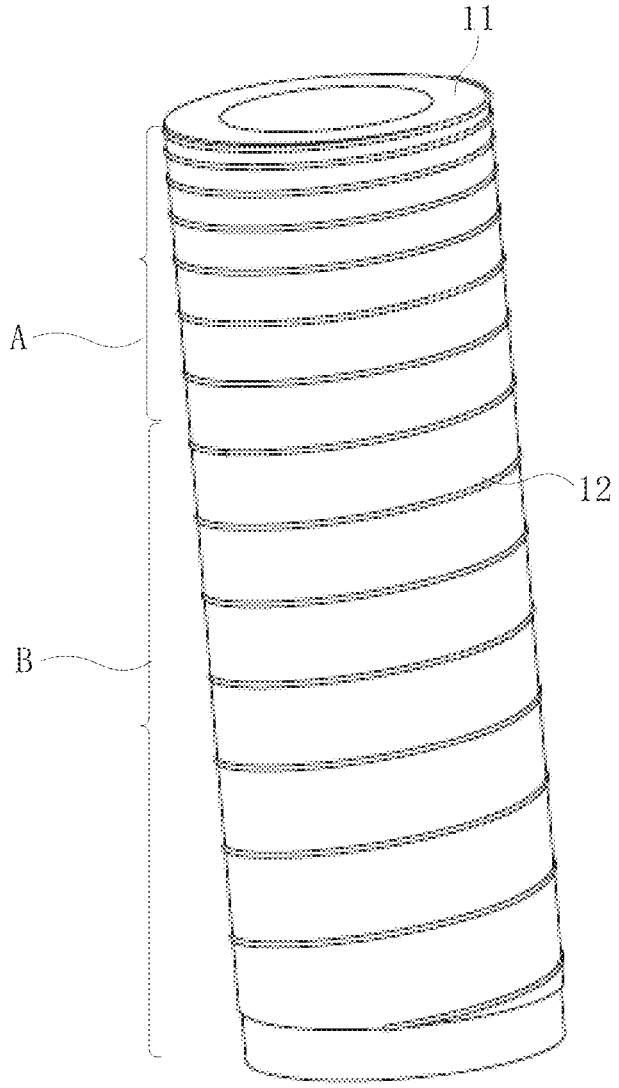
FIG. 7 is another diagram of a heater provided with a spiral electrode according to Embodiment 1 of the present disclosure.

Referring to FIG. 7, in an example, different from the example shown in FIG. 6, the spiral electrode extends along the longitudinal direction of the base 11 with a variable pitch. Here, the outer surface of the infrared film 13 includes a first area A and a second area B; the first area A approaches a downstream of an aerosol movement path (the dotted arrow in figure), the second area B approaches an upstream of the aerosol movement path. The pitch of the spiral electrode at the first area A is less than that at the second area B. Through the arrangement of different pitches for the spiral electrode at different areas of the infrared film 13, the heating speed of the aerosol generation matrix at the downstream area may be increased to achieve the effect of fast generation of smoke and improve the user experience.

Figure 8:
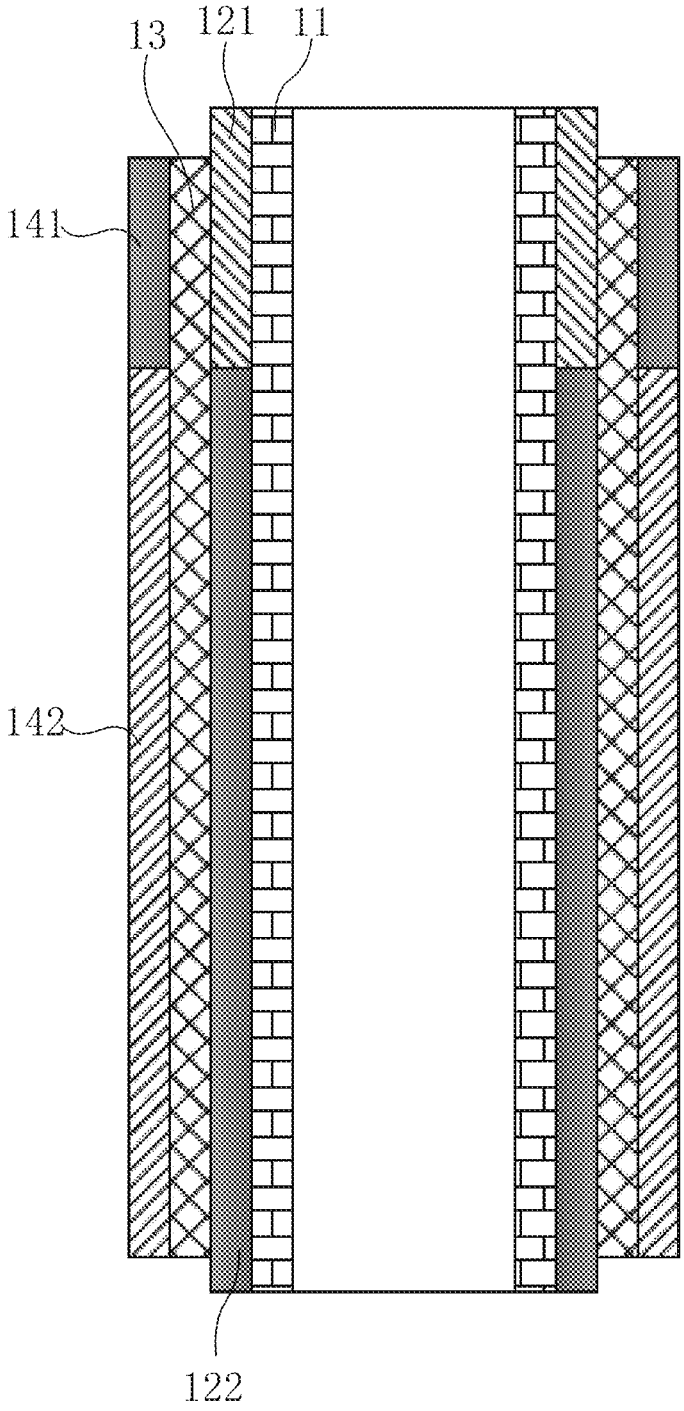
FIG. 8 is a diagram of segmented heating according to Embodiment 1 of the present disclosure.

Referring to FIG. 8, in an example, the first electrode film 12 is separated into a first partial electrode film 121 and a second partial electrode film 122 along the longitudinal direction of the base 11, and the second electrode film 14 is separated into a first partial electrode film 141 and a second partial electrode film 142 along the longitudinal direction of the base 11. Segmented heating of the aerosol forming matrix is performed by individually controlling the current fed to the first partial electrode films (121, 141) and/or the second partial electrode films (122, 142). The first partial electrode films (121, 141) and/or the second partial electrode films (122, 142) may be controlled at the same time, or may be controlled at different times. Segmented heating may ensure the heating speed of the aerosol generation matrix, the uniformity of flavor volatilization and the taste of smoking.

Further, the first partial electrode film 121 has a smaller length along the longitudinal direction of the base 11 than the second partial electrode film 122, and the first partial electrode film 141 has a smaller length along the longitudinal direction of the base 11 than the second partial electrode film 142. The first partial electrode films (121, 141) approach the downstream of the aerosol movement path, and the second partial electrode films (122, 142) approach the upstream of the aerosol movement path. Through the arrangement of partial electrode films of different lengths at different areas of the infrared film 13, the heating speed of the aerosol generation matrix at the downstream area may be increased to achieve the effect of fast generation of smoke and improve the user experience.

It is to be noted that the number of separations of the first electrode film 12 and the second electrode film 14 is not limited here. In other examples, it is possible that the first electrode film 12 is separated into a first partial electrode film 121 and a second partial electrode film 122, while the second electrode film 14 is not separated; alternatively, it is possible that the first electrode film 12 is not separated, while the second electrode film 14 is separated into a first partial electrode film 141 and a second partial electrode film 142 along the longitudinal direction of the base 11.

It is also to be noted that it is possible that the first electrode film 12 and/or the second electrode film 14 are(is) separated, along the circumferential direction of the base 11, into at least two portions that are electrically disconnected to each other, for example, a left half electrode film and a right half electrode film; correspondingly, the outer surface of the base 11 may be divided into a left half area and a right half area, which can be controlled individually to achieve controllable heating of different areas.

The infrared film 13 may be made of materials with high infrared radiance, such as oxide, carbon material, carbide or nitride. Specifically, metal oxides and multicomponent alloy oxides include ferric oxide, aluminum oxide, chromium trioxide, indium trioxide, lanthanum trioxide, cobalt trioxide, nickel trioxide, antimony trioxide, antimony pentoxide, titanium dioxide, zirconium dioxide, manganese dioxide, cerium dioxide, copper oxide, zinc oxide, magnesium oxide, calcium oxide, molybdenum trioxide and so on; or, a combination of two or more of the above metal oxides; or, a ceramic material having such a cell structure as spinel, perovskite and olivine.

The carbon material has an emissivity close to blackbody properties, with a high infrared radiance. The carbon material includes graphite, carbon fiber, carbon nanotube, graphene, diamond-like carbon film and so on.

The carbide includes silicon carbide, which has a high emissivity within a large infrared wavelength range (2.3 micrometers to 25 micrometers) and thus is a good near full-wave band infrared radiation material. In addition, the carbide further includes tungsten carbide, iron carbide, vanadium carbide, titanium carbide, zirconium carbide, manganese carbide, chromium carbide, niobium carbide and so on, all of which have a high infrared emissivity (MeC phase does not have strict chemical calculation composition and chemical formula).

The nitride includes metal nitrides and nonmetal nitrides, wherein the metal nitrides include titanium nitride, titanium carbonitride, aluminum nitride, magnesium nitride, tantalum nitride, vanadium nitride and so on; the nonmetal nitrides include boron nitride, phosphorus pentanitride, silicon nitride ($Si_3N_4$) and so on.

Other inorganic nonmetallic materials include silicon dioxide, silicate (including phosphosilicate, borosilicate, etc.), titanate, aluminate, phosphate, boride, sulfur compounds and so on.

The infrared film 13 may be formed on the outer surface of the base 11 by a physical vapor deposition method, a chemical vapor deposition method or a spraying method. Preferably, it is formed on the outer surface of the base 11 by a physical vapor deposition method.

It is to be noted that since the infrared film 13 has a large conductive cross-sectional area, the thickness of the infrared film 13 may be made very low, and the resistance value of the infrared film 13 may also be adjusted to a proper value range, for example, 2Ω.

Embodiment 2

Figure 9:
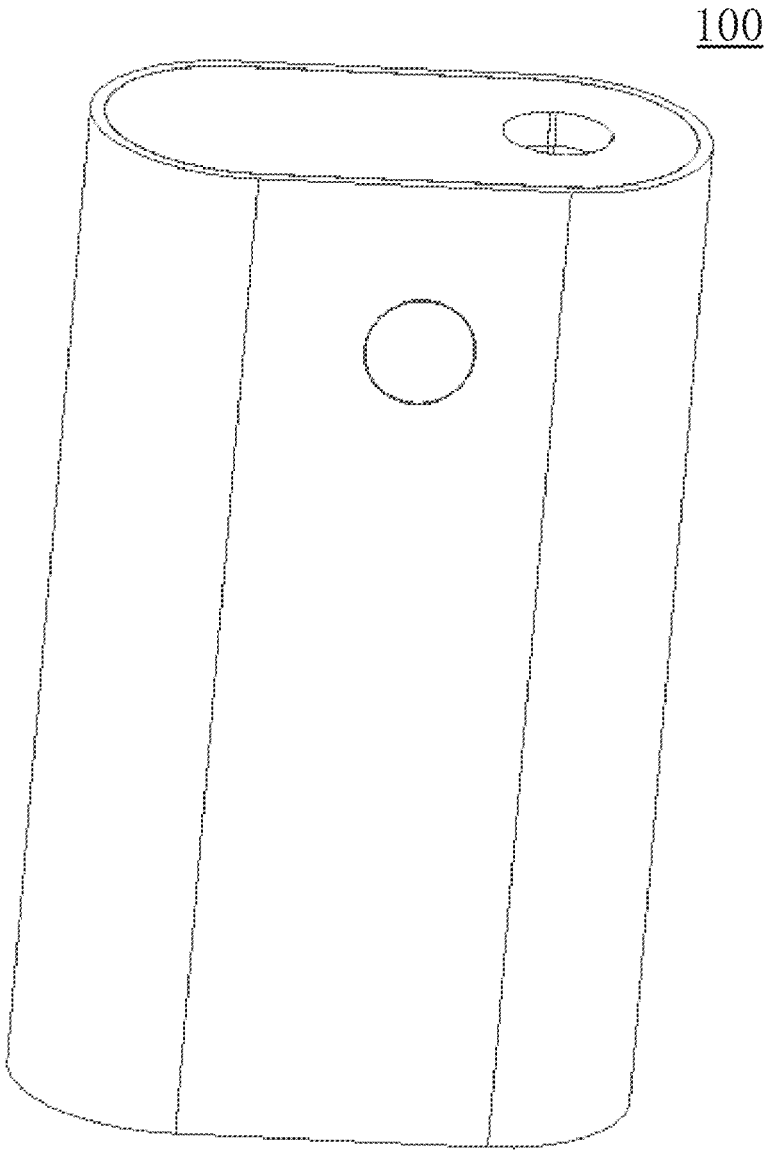
FIG. 9 is a diagram of a cigarette utensil according to Embodiment 2 of the present disclosure.
Figure 10:
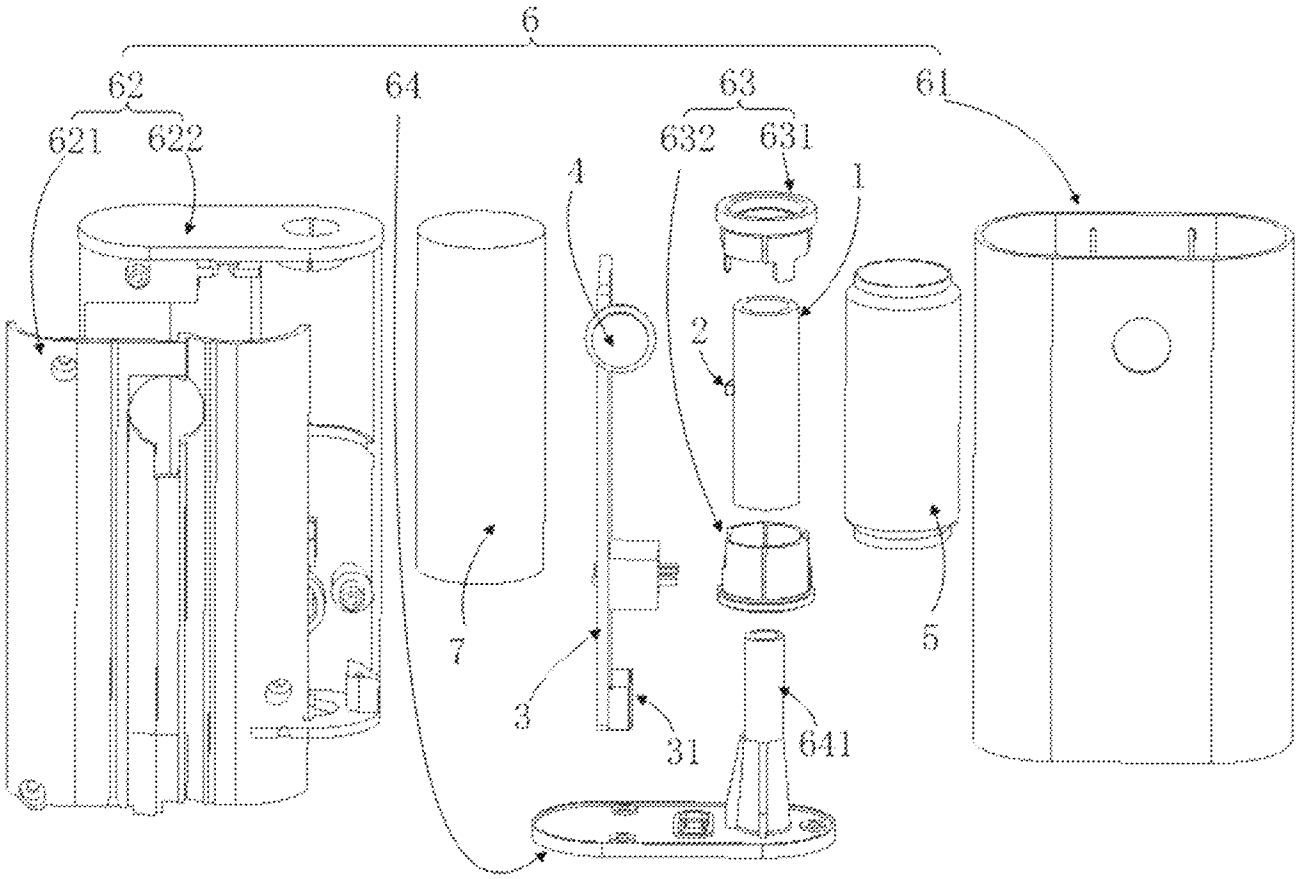
FIG. 10 is an exploded view of a cigarette utensil according to Embodiment 2 of the present disclosure.

FIG. 9 to FIG. 10 show a cigarette utensil 100 according to an Embodiment 2 of the present disclosure. The cigarette utensil 100 includes a shell assembly 6 and the above heater 1, and the heater 1 is arranged within the shell assembly 6. The heater 1 according to the present embodiment includes a first electrode film 12, an infrared film 13, and a second electrode film 14 that are deposited on the outer surface of the base 11 by a physical vapor deposition method. Under the function of the electric power, the infrared film 13 may generate heat and may generate infrared rays of certain wavelength, to heat the aerosol forming matrix within the chamber 111 of the base 11 in an infrared radiation manner.

The shell assembly 6 includes an outer shell 61, a fixing shell 62, a fixing element 63 and a bottom cover 64. The fixing shell 62 and the fixing element 63 are both fixed within the outer shell 61, wherein the fixing element 63 is configured for fixing the base 11, the fixing element 63 is arranged within the fixing shell 62, the bottom cover 64 is arranged on one end of the outer shell 61 and covers the outer shell 61. Specifically, the fixing element 63 includes an upper fixing seat 631 and a lower fixing seat 632, both of the upper fixing seat 631 and the lower fixing seat 632 are arranged within the fixing shell 62, a first end and a second end of the base 11 are fixed on the upper fixing seat 631 and the lower fixing seat 632 respectively, the bottom cover 64 is provided with an air inlet tube 641 in a protruding manner, one end of the lower fixing seat 632 away from the upper fixing seat 631 is connected to the air inlet tube 641, wherein the upper fixing seat 631, the base 11, the lower fixing seat 632 and the air inlet tube 641 are arranged coaxially, meanwhile, the base 11 is sealed with the upper fixing seat 631 and the lower fixing seat 632, the lower fixing seat 632 is also sealed with the air inlet tube 641, the air inlet tube 641 is communicated with external air to facilitate smooth inlet of air during the smoking process.

The cigarette utensil 100 further includes a master control circuit board 3 and a battery 7. The fixing shell 62 includes a front shell 621 and a rear shell 622, the front shell 621 is fixedly connected to the rear shell 622, both of the master control circuit board 3 and the battery 7 are arranged within the fixing shell 62, the battery 7 is electrically connected to the master control circuit board 3, a button 4 is protruded and arranged on the outer shell 61, and the infrared film 13 on the surface of the base 11 may be powered on or powered off by pressing the button 4. The master control circuit board 3 is further connected to a charging interface 31, the charging interface 31 is exposed on the bottom cover 64, and a user may charge or upgrade the cigarette utensil 100 through the charging interface 31 to ensure the continued usage of the cigarette utensil.

The cigarette utensil 100 further includes a heat insulation tube 5, the heat insulation tube 5 is arranged within the fixing shell 62, and the heat insulation tube 5 is arranged at the periphery of the heater 1 to prevent, at least partially, conduction of heat from the heater 1 towards the shell assembly 6. The heat insulation tube includes a heat insulation material, and the heat insulation material may be thermal insulation adhesive, aerogel, aerogel felt, asbestos, aluminum silicate, calcium silicate, diatomite, zirconia and so on. The heat insulation tube may also include a vacuum heat insulation tube. The heat insulation tube 5 may prevent a large amount of heat from being transferred to the shell 61 to cause the user to feel hot. An inner surface of the heat insulation tube 5 may further be provided with an infrared reflective coating, so as to reflect the infrared rays emitted by the infrared film 13 formed on the base 11 to the second electrode film 14, thereby increasing the heating efficiency.

The cigarette utensil 100 further includes an NTC temperature sensor 2, which is configured to detect the real-time temperature of the base 11 and transmit the detected real-time temperature to the master control circuit board 3, then the master control circuit board 3 adjusts the amplitude of the current flowing through the infrared film 13 according to the real-time temperature. Specifically, when the NTC temperature sensor 2 detects that the real-time temperature inside the base 11 is relatively low, for example, when detecting that the temperature inside the base 11 is lower than 150° C., the master control circuit board 3 controls the battery 7 to output a higher voltage to the first electrode film 12 and the second electrode film 14, thereby increasing the current fed to the infrared film 13, increasing the heating power of the aerosol forming matrix and reducing the time the user needs to wait before taking the first puff. When the NTC temperature sensor 2 detects that the temperature of the base 11 is 150° C. to 200° C., the master control circuit board 3 controls the battery 7 to output a normal voltage to the first electrode film 12 and the second electrode film 14. When the NTC temperature sensor 2 detects that the temperature of the base 11 is 200° C. to 250° C., the master control circuit board 3 controls the battery 7 to output a lower voltage to the first electrode film 12 and the second electrode film 14. When the NTC temperature sensor 2 detects that the temperature inside the base 11 is or above 250° C., the master control circuit board 3 controls the battery 7 to stop outputting a voltage to the first electrode film 12 and the second electrode film 14.

It is to be noted that the description of the present disclosure and the drawings just list preferred embodiments of the present disclosure. The present disclosure may, however, be exemplified in many different forms and should not be construed as being limited to the specific embodiments set forth herein. These embodiments are not intended to form extra limits to the content of the present disclosure, rather, they are provided so that this disclosure will be thorough and complete. Moreover, the above technical features may continue to combine with each other to form various embodiments not listed above, and these embodiments are all intended to be covered by the description of the present disclosure. Further, for the ordinary staff in this field, improvements or variations may be made according to the above description, and these improvements or variations are intended to be included within the scope of protection of the claims appended hereinafter.

What is claimed is:

1. A heater, configured to heat an aerosol forming matrix and vaporize at least one ingredient of the aerosol forming matrix to form an aerosol for a user to inhale, comprising:

a base provided with an inner surface and an outer surface; and a first electrode film, an infrared film, and a second electrode film sequentially formed on the outer surface of the base along a direction perpendicular to the outer surface of the base; wherein both of the first electrode film and the second electrode film are provided with an electrical connection portion, the electrical connection portion of the first electrode film is electrically connected to a positive electrode of a power supply and the electrical connection portion of the second electrode film is electrically connected to a negative electrode of the power supply, so that an electric power of the power supply is fed to the infrared film; and the infrared film is configured to receive the electric power and generate heat under a function of the electric power, the generated heat being used for heating the aerosol forming matrix.

2. The heater according to claim 1, wherein the first electrode film covers at least part of the outer surface of the base, the infrared film and the second electrode film cover part of an outer surface of the first electrode film;

the electrical connection portion of the first electrode film is formed on an outer surface portion of the first electrode film that is not covered by the infrared film and the second electrode film, and the electrical connection portion of the second electrode film is formed at any position on an outer surface of the second electrode film.

3. The heater according to claim 2, wherein the first electrode film has a greater length along a longitudinal direction of the base than the infrared film, and the second electrode film has an equal or smaller length along the longitudinal direction of the base than the infrared film.

4. The heater according to claim 2, wherein the first electrode film, the infrared film and the second electrode film are all continuous films.

5. The heater according to claim 2, wherein the first electrode film is a non-continuous film.

6. The heater according to claim 5, wherein the first electrode film is a patterned conductive track.

7. The heater according to claim 6, wherein the first electrode film comprises a current collecting portion and a finger electrode portion, at least part of the current collecting portion forms the electrical connection portion of the first electrode film, and electrode fingers of the finger electrode portion substantially extend along the outer surface of the base longitudinally.

8. The heater according to claim 6, wherein the first electrode film comprises a current collecting portion and a mesh electrode portion, and at least part of the current collecting portion forms the electrical connection portion of the first electrode film.

9. The heater according to claim 5, wherein the first electrode film comprises a first spiral electrode electrically connected to an inner surface of the infrared film, and the first spiral electrode extends spirally along a longitudinal direction of the base.

10. The heater according to claim 9, wherein the first spiral electrode extends along the longitudinal direction of the base with a constant pitch.

11. The heater according to claim 9, wherein the first spiral electrode extends along the longitudinal direction of the base with a variable pitch.

12. The heater according to claim 1, wherein at least one of the first electrode film and the second electrode film comprises at least two portions that are electrically disconnected to each other, to divide the outer surface of the base into at least a first area and a second area;

the first area and the second area can be controlled individually, to achieve controllable heating of different areas of the base.

13. The heater according to claim 12, wherein at least one of the first electrode film and the second electrode film is separated into a first partial electrode film and a second partial electrode film along a longitudinal direction of the base, and segmented heating of the aerosol forming matrix is performed by individually controlling the electric power fed to at least one of the first partial electrode film and the second partial electrode film.

14. The heater according to claim 1, wherein the first electrode film comprises at least one of silver, gold, platinum or copper.

15. The heater according to claim 1, wherein the second electrode film comprises at least one of gold, silver, aluminum, platinum, titanium, or indium tin oxide.

16. The heater according to claim 14, wherein the first electrode film and the second electrode film are prepared by a physical vapor deposition method.

17. The heater according to claim 1, wherein the base comprises at least one of quartz glass, sapphire, silicon carbide, magnesium fluoride ceramic, yttrium oxide ceramic, magnesium aluminum spinel ceramic, yttrium aluminum garnet single crystal or germanium single crystal.

18. A cigarette utensil, comprising a shell assembly, and the heater according to claim 1, wherein the heater is arranged within the shell assembly.

19. The cigarette utensil according to claim 18, further comprising a hollow heat insulation tube; wherein the heat insulation tube is arranged at a periphery of the heater, to prevent, at least partially, conduction of heat from the heater towards the shell assembly.

* * * * *